United States Patent [19]

Harnisch

[11] 4,411,946

[45] Oct. 25, 1983

[54] IMPREGNATING PAPER WITH 7-HYDROXY-COUMARIN COMPOUNDS

[75] Inventor: Horst Harnisch, Much, Fed. Rep. of Germany

[73] Assignee: Bayer Aktiengesellschaft, Leverkusen, Fed. Rep. of Germany

[21] Appl. No.: 333,517

[22] Filed: Dec. 22, 1981

[30] Foreign Application Priority Data

Jan. 8, 1981 [DE] Fed. Rep. of Germany ..... 3100295

[51] Int. Cl.[3] ..... B32B 21/04; D21H 5/10

[52] U.S. Cl. ..... 428/219; 428/220; 428/537; 428/915; 428/916; 427/7; 427/395

[58] Field of Search ..... 428/537, 915, 219, 916, 428/220; 427/7

[56] References Cited

U.S. PATENT DOCUMENTS

| | | | |
|---|---|---|---|
| 2,673,186 | 3/1954 | Wheelock et al. | 252/534 X |
| 3,886,083 | 5/1975 | Laxer | 428/916 X |
| 4,136,229 | 1/1979 | Godet et al. | 428/916 X |

OTHER PUBLICATIONS

Venkatarman, The Chemistry of Synthetic Dyes, 1971, vol. 5, pp. 590–591.

*Primary Examiner*—P. Ives

*Attorney, Agent, or Firm*—Sprung, Horn, Kramer & Woods

[57] ABSTRACT

7-Hydroxy-coumarin compounds of the general formula wherein

A represents a heterocyclic radical, which can contain non-ionic substituents customary in dye-stuff chemistry, R represents hydrogen or cyano and Z represents oxygen or NH and the ring B can be further substituted non-ionically, are used for impregnating paper, in particular paper which has to be made forgery-proof.

8 Claims, No Drawings

IMPREGNATING PAPER WITH 7-HYDROXY-COUMARIN COMPOUNDS

The invention relates to the use of 7-hydroxycoumarin compounds of the general formula

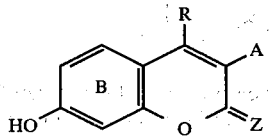

I wherein

A represents a heterocyclic radical, which can contain non-ionic substituents customary in dyestuff chemistry, R represents hydrogen or cyano and Z represents oxygen or NH and the ring B can be further substituted non-ionically, in particular by a $C_1$-alkyl group to $C_3$-alkyl group or a chlorine atom, for impregnating paper, in particular for impregnating paper which has to be made forgery-proof.

German Offenlegungsschrift No. 2,747,349 stresses the superiority of pyranine, for impregnating papers which have to be made forgery-proof, over indicators used hitherto. Surprisingly, compounds of the formula I can be used advantageously for impregnating papers of this type despite the absence of sulphonic acid groups which impart solubility in water. When subjected to ink erasers which give an alkaline reaction, the compounds of the formula I exhibit a superior yellow or red coloration, which is distinguished by its high color intensity and fastness.

The heterocyclic radicals A can, for example, belong to the oxazole, benzoxazole, thiazole, benzthiazole, imidazole, benzimidazole, furan, benzo[b]furan, thiophene, benzo[b]thiophene, pyridine, quinoline, pyrimidine, quinazolone, quinoxaline, 1,2,4-benzthiadiazine-1,1-dioxide, 1,3,4-oxadiazole, 1,3,4-thiadiazole, 1,2,3-triazol-1-, 1,2,3-triazole-2-, 1,2,4-triazole-1- or benzo-s-triazole series, it being possible for still a further benzo ring to be fused onto the benzo-fused heterocyclic structures listed.

Preferred heterocyclic radicals A are those of the benzthiazole, benzoxazole, benzimidazole, quinazol-4-one, benz[b]furan, benz[b]thiophene, 5-phenyl-1,3,4-oxadiazole, 5-phenyl-1,3,4-thiadiazole or pyridine series.

Suitable substituents customary in dyestuff chemistry are, for example, $C_1$- to $C_4$-alkyl, $C_1$- to $C_4$-alkoxy, phenyl-$C_1$- to $C_3$-alkyl, cyclohexyl, phenyl which may be monosubstituted or disubstituted by $C_1$- to $C_4$-alkyl, $C_1$- to $C_2$-alkoxy and/or chlorine, trifluoromethyl, chlorine, $C_1$- to $C_4$-alkoxycarbonyl, carboxyl, carbamoyl groups or sulphamoyl groups, which may be monosubstituted or disubstituted by $C_1$- to $C_4$-alkyl radicals, $C_1$- to $C_4$-alkylsulphonyl, phenyl-$C_1$- to $C_3$-alkylsulphonyl, phenylsulphonyl, $C_1$- to $C_4$-alkylmercapto and phenylmercapto.

Preferred compounds, within the scope of the invention, are those of the formula

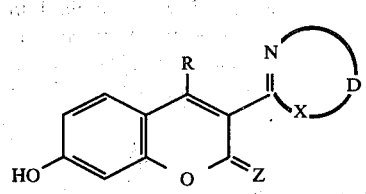

II wherein

Z represents oxygen or NH,

R represents hydrogen or cyano,

X represents —O—, —S— or —N($R^1$)—, $R^1$ represents hydrogen, $C_1$- to $C_4$-alkyl, benzyl or phenyl and D represents the remaining members of a benzoxazol-2-yl, benzthiazol-2-yl, benzimidazol-2-yl, quinazol-4-on-2-yl, 5-phenyl-1,3,4-oxadiazol-2-yl or 5-phenyl-1,3,4-thiadiazol-2-yl radical, and D can be monosubstituted or disubstituted by $C_1$- to $C_4$-alkyl, chlorine, $C_1$- to $C_2$-alkoxy, phenyl, cyclohexyl, $C_1$- to $C_4$-alkylsulphonyl, carboxyl or $C_1$- to $C_2$-alkoxycarbonyl.

Those compounds of the formula II have particular industrial importance in which Z represents oxygen and R represents hydrogen and X and D together form a benzoxazole ring system which may be substituted in the indicated manner.

The compounds of the formula I are largely known (German Offenlegungsschrift 2,702,237) or can be prepared by known methods, in particular by condensing a resorcylaldehyde

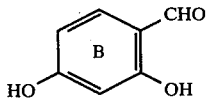

III wherein

B has the abovementioned meaning, with a compound of the formula $$A—CH_2—Q \qquad IV$$

wherein

Q represents a carboxyl group which may have been functionally modified and

A has the abovementioned meaning, so as to form a coumarin ring and, if appropriate, subsequently cyaniding the condensation product with alkali metal cyanide/bromine in a manner which is in itself known.

Possible functionally modified carboxyl groups are in particular $C_1$- to $C_4$-alkyl esters, carboxamides which may be monosubstituted or disubstituted by $C_1$- to $C_4$-alkyl radicals, carbopiperidide, carbopyrrolidide, carbomorpholide, carbothiomorpholide, carbopiperazide and the nitrile group.

In the case of Q=CN, coumarin-2-imide (formula I with Z=NH) which is primarily formed during the condensation can subsequently, if desired, be hydrolyzed to give the coumarin compound I (with Z=O) by treatment with an aqueous mineral acid, such as hydrochloric acid or sulphuric acid.

The method which is in itself known of introducing a 4-cyano group into the coumarin ring system using alkali metal cyanide and bromine, which serves here for preparing the compounds of the formula I in which R=CN, is described in Dyes and Pigments, 1, (1980), 3–15 and in German Offenlegungsschrift No. 2,844,299. A possible solvent is dimethylformamide. The reaction is carried out, for example at 10°–50° C., initially using a solution of an alkali metal cyanide, and then oxidation is carried out with bromine at 0°–10° C.

The 7-hydroxy-coumarin compounds of the formula I are appropriately used in the form of an aqueous suspension or dispersion having a content of active substance of 0.01 to 0.5, preferably 0.05 to 0.2, percent by weight in the pH range of less than 6, in particular of 5 to 1. A very high degree of dispersion can be achieved advantageously by the addition of 1–10 percent by weight of an acid-stable, preferably non-ionic dispersing agent, such as, for example, a polyether made from oleyl alcohol and 20–50 mols of ethylene oxide. A paper size is produced from the dispersion obtained, advantageously by adding a customary sizing agent, such as oxidized starch (5–15 percent by weight), and paper is impregnated with this paper size, so that the concentration is about 0.05 to 0.2 g of reagent per $m^2$. White paper is obtained which gives an intense, very fast yellow or red coloration when treated with an ink erasing pen or with another alkaline reagent.

EXAMPLE 1

0.1 g of the compound of the formula

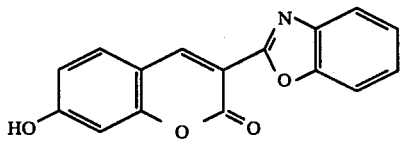

(1)

prepared by condensing ethyl benzoxazol-2-yl acetate with resorcylaldehyde in boiling ethanol using piperidine acetate as catalyst, is finely dispersed in 100 ml of water by adding 0.005 g of a dispersing agent (polyether from oleyl alcohol and 50 mols of ethylene oxide), 10 g of oxidized starch are added and the pH of the mixture is adjusted to 2 using hydrochloric acid. Paper is impregnated with the dispersion obtained, so that the concentration is about 0.1 g of reagent/$m^2$. White paper is obtained which gives an intense yellow-green, very fast coloration when treated with an ink erasine pen.

Similarly good effects are obtained, if instead of the compound 1 an equivalent amount of one of the following substances is used:

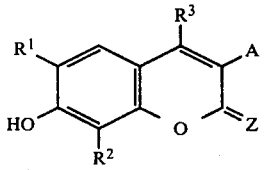

| Example | $R^1$ | $R^2$ | $R^3$ | Z | A | Shade developed (alkaline) |
|---|---|---|---|---|---|---|
| 2 | H | H | H | O | 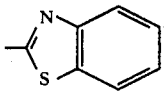 | yellow |
| 3 | " | " | " | " | 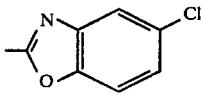 | " |
| 4 | " | " | " | " | 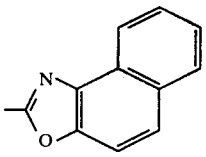 | " |
| 5 | " | " | " | " | 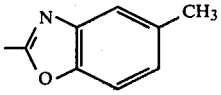 | " |
| 6 | " | " | " | " | 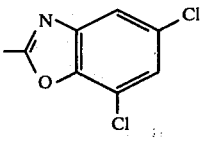 | " |

-continued
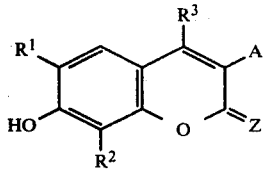
| Example | $R^1$ | $R^2$ | $R^3$ | Z | A | Shade developed (alkaline) |
|---|---|---|---|---|---|---|
| 7 | $CH_3$ | " | " | " | 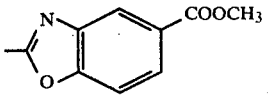 | " |
| 8 | H | Cl | " | " | 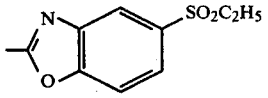 | " |
| 9 | " | H | " | " | 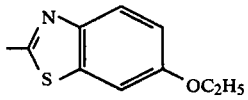 | " |
| 10 | " | " | " | " | 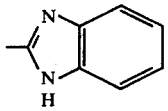 | " |
| 11 | " | " | " | " | 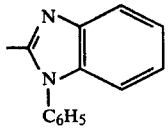 | " |
| 12 | " | " | " | " | 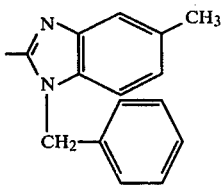 | " |
| 13 | " | " | " | " | 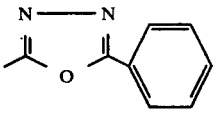 | " |
| 14 | " | " | " | " | 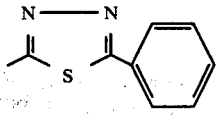 | " |
| 15 | " | " | " | " | 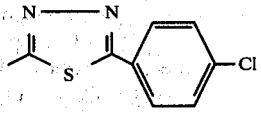 | " |
| 16 | " | " | " | " | 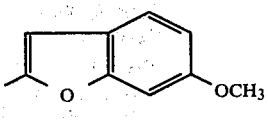 | " |

-continued

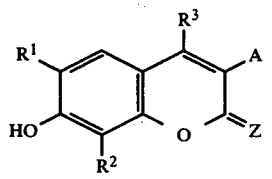

| Example | $R^1$ | $R^2$ | $R^3$ | Z | A | Shade developed (alkaline) |
|---|---|---|---|---|---|---|
| 17 | " | " | " | " | 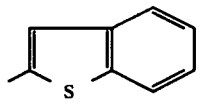 | " |
| 18 | " | " | " | " | 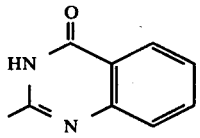 | " |
| 19 | " | " | " | " | 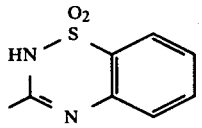 | " |
| 20 | " | " | " | " | 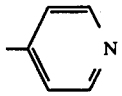 | " |
| 21 | " | " | " | NH | 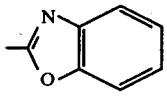 | " |
| 22 | " | " | CN | O | 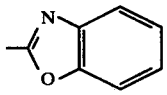 | red |
| 23 | " | " | " | " | 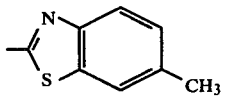 | " |
| 24 | " | " | " | " | 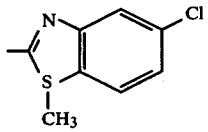 | ". |

I claim:

1. Security paper having incorporated therein between about 0.01 and about 0.2 grams per meters$^2$ of a 7-hydroxy-coumarin compound of the general formula

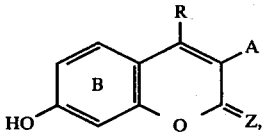

wherein

A represents a heterocyclic radical belonging to the benzthiazole, benzoxazole, benzimidazole, quinazol-4-one, benzo (b) thiophene, benzo (b) furan, 5-phenyl-1,3,4-oxadiazole, 5-phenyl-1,3,4-thiadiazole or pyridine series and the substituents on A are chosen from the series $C_1$- to $C_4$-alkyl, $C_1$- to $C_4$-alkoxy, phenyl-$C_1$- to $C_3$-alkyl, cyclohexyl, phenyl which is unsubstituted, monosubstituted or disubstituted wherein said substitution is by $C_1$- to $C_4$-alkyl, $C_1$- to $C_2$-alkoxy and/or chlorine, trifluoromethyl, $C_1$- to $C_4$-alkoxycarbonyl, carboxyl, carbamoyl groups or sulphamoyl groups which are unsubstituted, monosubstituted or disubstituted wherein said substitution is by $C_1$- to $C_4$-alkyl radicals, $C_1$- to $C_4$-alkylsulphonyl, phenyl-$C_1$- to $C_3$-alkylsulphonyl, phenylsulphonyl, $C_1$- to $C_4$-alkylmercapto and phenylmercapto, R represents hydrogen or cyano and Z represents oxygen or NH and the ring B is further unsubstituted or substituted nonionically by a $C_1$- to $C_3$-alkyl group or chlorine.

2. Security paper having incorporated therein between about 0.01 and about 0.2 grams per meters$^2$ of a 7-hydroxy-coumarin compound of the formula

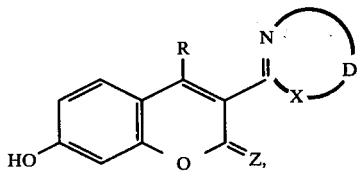

wherein

Z represents oxygen or NH,

R represents hydrogen or cyano,

X represents —O—, —S— or —N($R^1$)—, $R^1$ represents hydrogen, $C_1$- to $C_4$-alkyl, benzyl or phenyl and D represents the remaining members of a benzoxazol-2-yl, benzthiazol-2-yl, benzimidazol-2-yl, quinazol-4-on-2-yl, 5-phenyl-1,e,4-oxadiazol-2-yl or 5-phenyl-1,3,4-thiadiazol-2-yl radical, and D is unsubstituted, monosubstituted or disubstituted wherein said substitution is by $C_1$- to $C_4$-alkyl, chlorine, $C_1$-$C_2$-alkoxy, phenyl, cyclohexyl, $C_1$- to $C_4$-alkylsulphonyl, carboxyl or $C_1$- to $C_2$-alkylcarbonyl.

3. Security paper according to claim 2 wherein

Z represents oxygen,

R represents hydrogen and

X and D together form a benzoxazole ring system which is unsubstituted or substituted in the manner indicated in claim 2.

4. Security paper according to claim 1 wherein the 7-hydroxy-compound is one in which R is a cyano group.

5. A process for impregnating paper which comprises effecting impregnation by means of 7-hydroxy-coumarin compounds of the general formula

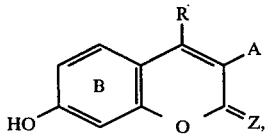

wherein

A represents a heterocyclic radical belonging to the benzthiazole, benzoxazole, benzimidazole, quinazol-4-one, benzo (b) thiophene, benzo (b) furan, 5-phenyl-1,3,4-oxadiazole, 5-phenyl-1,3,4-thiadiazole or pyridine series and the substituents on A are chosen from the series $C_1$- to $C_4$-alkyl, $C_1$- to $C_4$-alkoxy, phenyl-$C_1$- to $C_3$-alkyl, cyclohexyl, phenyl which is unsubstituted, monosubstituted or disubstituted wherein said substitution is by $C_1$- to $C_4$-alkyl, $C_1$- to $C_2$-alkoxy and/or chlorine, trifluoromethyl, $C_1$- to $C_4$-alkoxycarbonyl, carboxyl, carbamoyl groups or sulphamoyl groups which are unsubstituted, monosubstituted or disubstituted wherein said substitution is by $C_1$- to $C_4$-alkyl radicals, $C_1$- to $C_4$-alkylsulphonyl, phenyl-$C_1$- to $C_3$-alkylsulphonyl, phenylsulphonyl, $C_1$- to $C_4$-alkylmercapto and phenylmercapto, R represents hydrogen or cyano and Z represents oxygen or NH and the ring B is further unsubstituted or substituted non-ionically by a $C_1$- to $C_3$-alkyl group or chlorine.

6. A process of claim 5 wherein the 7-hydroxy-coumarin compound is one in which R represents cyano.

7. A process for impregnating paper which comprises effecting impregnation by means of 7-hydroxy-coumarin compounds of the formula

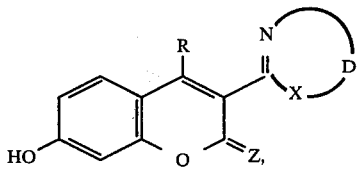

wherein

Z represents oxygen or NH,

R represents hydrogen or cyano,

X represents —O—, —S— or —N($R^1$)—, $R^1$ represents hydrogen, $C_1$- to $C_4$-alkyl, benzyl or phenyl and D represents the remaining members of a benzoxazol-2-yl, benzthiazol-2-yl, benzimidazol-2-yl, quinazol-4-on-2-yl, 5-phenyl-1,3,4-oxadiazol-2-yl or 5-phenyl-1,3,4-thiadiazol-2-yl radical, and D is unsubstituted, monosubstituted or disubstituted by $C_1$- to $C_4$-alkyl, chlorine, $C_1$-$C_2$-alkoxy, phenyl, cyclohexyl, $C_1$- to $C_4$-alkylsulphonyl, carboxyl or $C_1$- to $C_2$-alkylcarbonyl, for impregnating paper.

8. A process for impregnating paper which comprises effecting impregnation by means of 7-hydroxy-coumarin compounds according to claim 7, wherein Z represents oxygen and R represents hydrogen and X and D together form a benzoxazole ring system which is unsubstituted or substituted in the manner indicated in claim 7.

* * * * *